US005537989A

United States Patent [19]

York, Jr. et al.

[11] Patent Number: 5,537,989

[45] Date of Patent: Jul. 23, 1996

[54] CANDLE WICK EXTRACTING AND POSITIONING DEVICE AND METHOD

[76] Inventors: Ray A. York, Jr.; Shelley Dukes, both of 849 Almar Ave., #C109, Santa Cruz, Calif. 95060

[21] Appl. No.: 377,186

[22] Filed: Jan. 24, 1995

[51] Int. Cl.[6] ..... F23D 14/46

[52] U.S. Cl. ..... 126/406; 126/401; 431/289; 431/345

[58] Field of Search ..... 126/120, 401, 126/402, 403, 404, 405, 406, 407, 408, 409, 410, 411, 412, 413, 414, 25 C, 230, 231, 232, 233, 234, 235, 236; 431/266, 345, 253, 289; 30/309, 310, 352, 357; 433/32; 606/27, 28

[56] References Cited

U.S. PATENT DOCUMENTS

| | | | |
|---|---|---|---|
| 273,085 | 2/1883 | Houchin | 431/253 |
| 517,180 | 3/1894 | Wilson | 126/406 |
| 597,746 | 1/1898 | Schneider | 126/407 |
| 658,591 | 9/1900 | Schlegel | 126/406 |
| 954,483 | 4/1910 | Urbantsek | 126/406 |
| 998,397 | 7/1991 | Rohsow et al. | 126/405 |
| 1,016,209 | 1/1912 | Chenot | 431/253 |
| 1,065,456 | 6/1913 | Lowrey | 30/352 |
| 1,966,374 | 7/1934 | Brandenburg | 433/32 |
| 2,220,738 | 11/1940 | Stoddard | 126/401 |
| 2,698,653 | 1/1955 | Hollaway | 126/401 |
| 2,972,035 | 2/1961 | Miller | 30/140 |
| 5,123,837 | 6/1992 | Farnham et al. | 431/255 X |

*Primary Examiner*—Carl D. Price
*Attorney, Agent, or Firm*—John R. Flanagan

[57] ABSTRACT

A device for extracting and positioning an embedded ignitable end of a candle wick includes a coupling element mountable at the flame discharge end of candle lighter, a working element adapted to be maneuvered to extract the embedded ignitable end of the candle wick from candle wax and to reposition the extracted ignitable end of the candle wick at a position free from the wax, and an elongated support member with the coupling element attached to one of the opposite ends of the support member such that the support member extends along a flame exiting from the flame discharge end of the candle lighter. The working element is attached to the other of the opposite ends of the support member such that the working element is spaced forwardly of the flame discharge end of the candle ligher and positioned in proximity to flame so that the working element is heated by the flame.

2 Claims, 3 Drawing Sheets

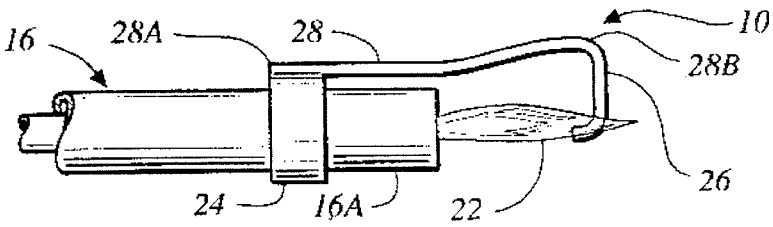
FIG._4A
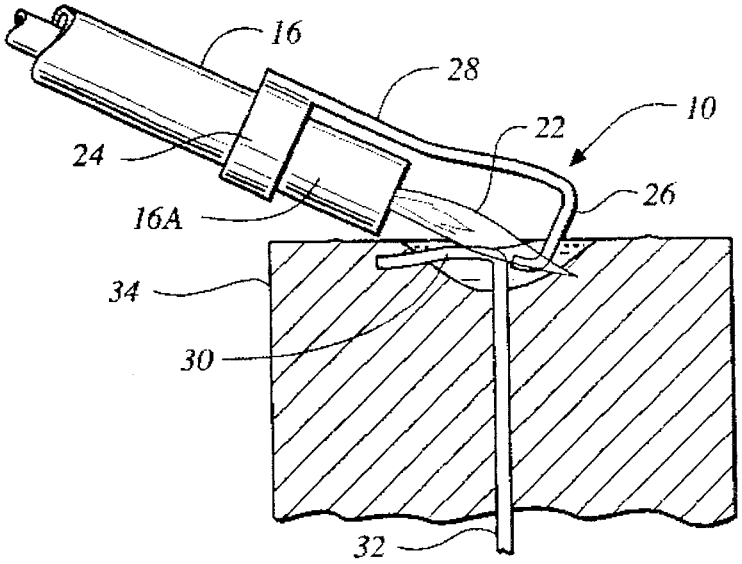
FIG._4B
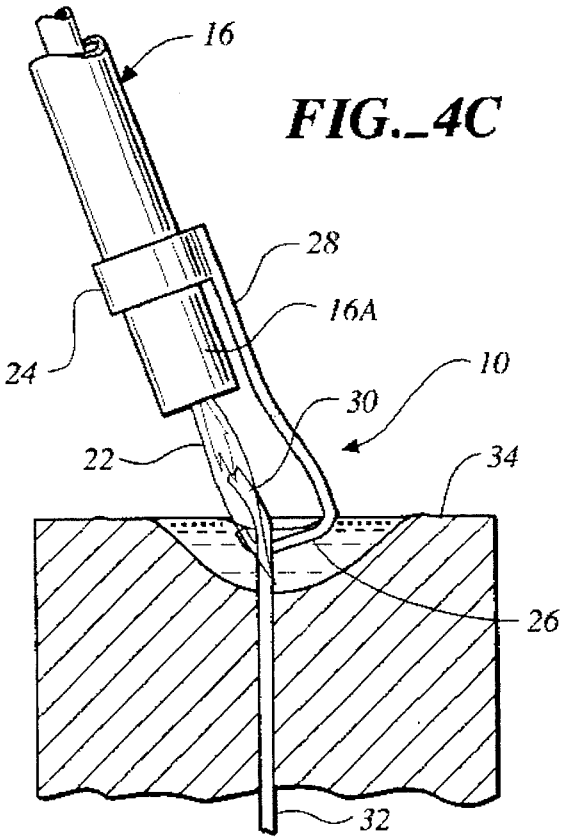
FIG._4C
FIG._4D
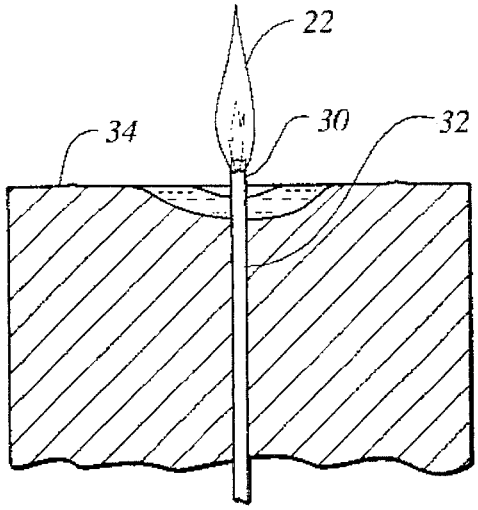

CANDLE WICK EXTRACTING AND POSITIONING DEVICE AND METHOD

BACKGROUND OF THE INVENTION

1. Field of the Invention

The present invention generally relates to candle lighter apparatus and, more particularly, is concerned with a candle wick extracting and positioning device and method which facilitates the lighting of candles in confined areas and with the ignitable ends of the wicks either partially or wholly embedded in the candle wax.

2. Description of the Prior Art

Lighters commonly found in use today are often limited in their ability to light candle arrangements. Available lighters which use flammable gas, such as cigarette lighters, are unhandy and impractical for igniting the ends of wicks of relatively large candles such as those which are four or more inches in diameter and ten or more inches in height, especially after the wick has burned down several inches.

Further, where candles are placed in containers, such as a vase or hurricane lamp, the same problem exists. Ordinary friction safety matches do not have the length necessary for lighting these candles and thus carry a high risk of burning the user's fingers when attempting to do so.

Several commercially available products exist which attempt to solve the aforementioned problem but leave additional problems unresolved. Longer matches may serve to reach deeper wicks, however they tend to break after being lit and leave unsightly match debris in the candle wax which disturb the natural burn path of the candle wick. Flammable gas lighters which have straight rods may also reach the deeper wicks, however they are unhandy in that the user must often lift and turn the candle at an angle in order to present the flame to the wick.

An additional problem is present and common to most candles of relatively large diameters, such as four or more inches. As the interior wall of the candle melts, the wax tends to pool around the wick stem and when allowed to cool may bury and/or embed the ignitable end of the wick. It is then necessary to dig the wax away and extract the end of the wick in some manner to place it at an ignitable position. Non-flammable gas candle lighters of wick material may have the length and curved rod desirable to light such candle wick arrangements, however they do not have a means to extract the wax embedded ignitable ends of the candle wicks.

In view of the foregoing problems, a need has long existed for a device to melt wax embedding the ignitable ends of candle wicks and extract and reposition the ignitable wick ends to a position above the wax as well as a device being suitable for lighting candles of all candle arrangements including those with difficult-to-reach candle wicks.

SUMMARY OF THE INVENTION

The present invention provides a candle wick extracting and positioning device and method designed to satisfy the aforementioned needs. The device and method of the present invention facilitates lighting of candles in confined areas and with wicks having their ignitable ends either partially or wholly embedded in the candle wax. The primary purpose of the present invention is to provide a device which will cause the melting of wax and extracting of the ignitable end of a wick from the wax so as to facilitate lighting of candles having wicks with ignitable ends either partially or wholly embedded in wax and inaccessible to an ordinary match or lighter. Secondarily, the purpose of the present invention is to make the lighting of any candle easier and particularly those candles whose wick ends are surrounded on all sides, except the top, by a vase, container, or the sides of the candle itself.

The wick extracting and positioning device of the present invention can be advantageously provided as an accessory attachable to certain existing candle lighters and as original equipment incorporated into a candle lighter at the factory. The convenience and value of the present invention can be realized in diverse settings, not only in homes but also in restaurants, churches and nightclubs.

Accordingly, the present invention is directed to a candle wick extracting and positioning device for use on a flame discharge end of a candle lighter, comprising: (a) a coupling element connectable to the flame discharge end of the candle lighter; (b) a working element adapted to be maneuvered to extract an ignitable end of a candle wick from candle wax and to reposition the extracted ignitable end of the candle wick at an orientation free from the wax; and (c) an elongated support member having a pair of opposite ends, said coupling element being attached to one of said opposite ends of said support member such that said support member extends along a flame exiting from the flame discharge end of the candle lighter, said working element being attached to the other of said opposite ends of said support member such that said working element is spaced forwardly of the flame discharge end of the candle ligher and positioned in proximity to flame so that the working element is heated by the flame.

The present invention is also directed to the combination of a candle lighter and a candle wick extracting and positioning device having the above-described construction. The candle lighter has a hand grip and elongated member with a flame discharge end. The device is mounted to the flame discharge end of the elongated member of the candle lighter.

The present invention is further directed to a method for extracting and positioning an ignitable end of a candle wick embedded in candle wax. The method comprises the steps of: (a) providing a candle lighter having a candle wick extracting and positioning device mounted to a flame discharge end of the candle lighter with a working element of the device disposed in proximity to a flame produced at the flame discharge end; (b) heating the working element of the extracting and positioning device by projecting the flame toward the working element; (c) melting the wax of the candle embedding the ignitable end of the candle wick by heating the wax through contact with the flame and the heated working element of the device; and (d) engaging the ignitable end of the candle wick with the heated working element of the device and raising the ignitable end of the wick from the wax to an upright position above the candle surface. The method further comprises the step of contacting the flame with the raised ignitable end of the candle wick to ignite the raised end of the candle wick.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIGS. 4A to 4D are diagrammatic views illustrating the sequence of steps of the extracting and positioning method of the present invention.

DETAILED DESCRIPTION OF THE INVENTION

Figure 1:
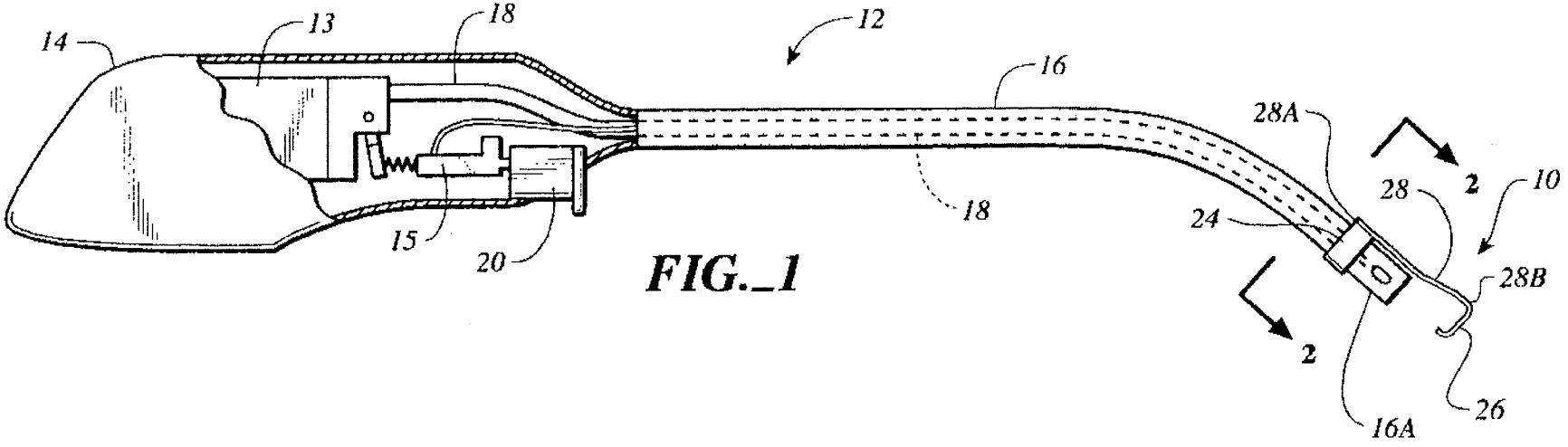
FIG. 1 is a side elevational view with portions broken away of a candle lighter having mounted thereto a candle wick extracting and positioning device in accordance with the principles of the present invention.
Figure 2:
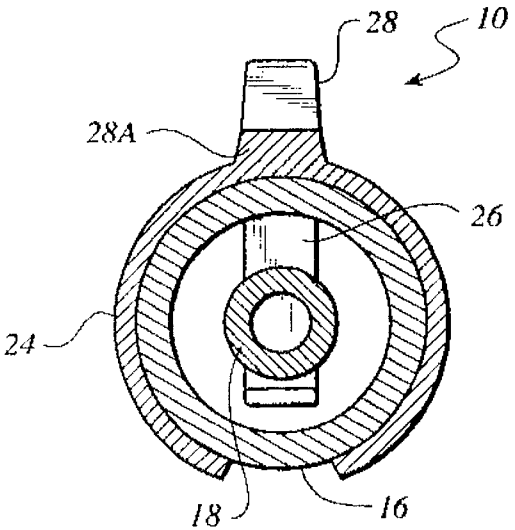
FIG. 2 is an enlarged cross-sectional view taken along line 2—2 of FIG. 1.

Referring to the drawings and particularly to FIGS. 1 and 2, there is illustrated a candle wick extracting and positioning device 10 of the present invention being mounted to a conventional candle lighter 12. As well-known, the candle lighter 12 typically includes a hand grip 14 and an elongated rod 16 attached at one end to the hand grip 14 and extending therefrom. The lighter 12 also includes an elongated flame transport tube 18 enclosed in the rod 16, and a compressed gas container 13 and an ignition device 15 enclosed in the hand grip 14. The compressed gas container 13 has a refill nozzle and an discharge nozzle. The ignition device 15 of the lighter 12 is disposed between the discharge nozzle of the gas container and the inlet end of the transport tube 18. An actuating switch 20 protrudes from the exterior of the hand grip 14 and is depressible by a user to cause in a known manner the discharge of gas from the gas container 13 into the transport tube 18 and the igniting of the gas by the ignition device 15 to produce a flame 22 which travels to and projects from the outlet end of the transport tube 18, as shown in FIG. 4A, at the forward flame discharge end 16A of the elongated rod 16 of the candle lighter 12. Also, as clearly seen in FIG. 1, the elongated rod 16 is generally straight for most of its length and then is curved in shape near of adjacent to the discharge end 16A thereof so as to dispose the extracting and positioning device 10 at an angle relative to the elongated rod 16 which enhances the ability of a user to maneuver the candle lighter 12 and device 10 therewith to use the device 10 in extracting and positioning an embedded candle wick.

The extracting and positioning device 10 of the present invention basically includes a coupling element 24, a working tip or element 26, and a support member 28. The coupling element 24 of the device 10 is mountable to the flame discharge end 16A of the rod 16 of the candle lighter 12. The coupling element 24 can have different configurations and can be mounted to the rod 16 so as to be easily removed and replaced or can be fixedly mounted thereto. In one exemplary form shown in FIG. 2, the coupling element 24 has an annular configuration and more particularly is in the shape of a ring 24 adapted to slidably and snugly fit over the rod 16.

The working element 26 of the device 10 has any one of many possible configurations adapting it to be used to extract an ignitable end 30 of a candle wick 32 embedded in candle wax 34 and to position the extracted ignitable end 30 of the candle wick 32 at an orientation free from the wax 34. The elongated support member 28 of the device 10 positions the working element 26 at a desired position relative to the flame discharge end 16A of the rod 16 of the candle lighter 12.

More particularly, the support member 28 is rigidly attached at an inner end 28A to the coupling element 24 such that the support member 28 extends forwardly from the flame discharge end 16A of the elongated rod 16 of the candle lighter 12 and along the flame 22 exiting therefrom. The working element 26 is rigidly attached to the outer end 28B of the support member 28 such that the working element 26 is spaced forwardly of the flame discharge end 16A of the candle lighter rod 16 and positioned in proximity to the flame 22, and more specifically across the flame 22, so that the working element 26 is heated by the flame 22. The device 10 can be made using conventional fabrication techniques and from a suitable material, an example of which is copper.

Figure 3A:
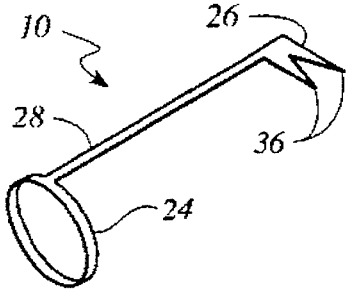
FIGS. 3A to 3K are perspective views of extracting and positioning devices with working elements of different alternative configurations.
Figure 3B:
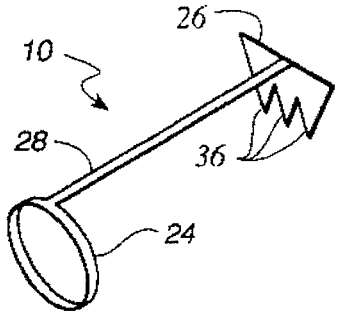
Figure 3C:
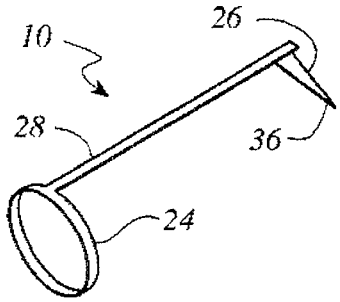
Figure 3D:
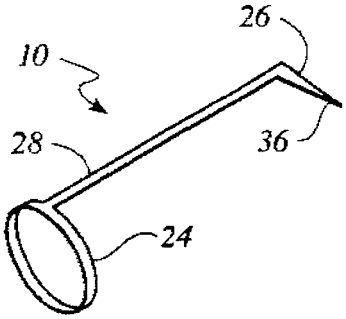
Figure 3E:
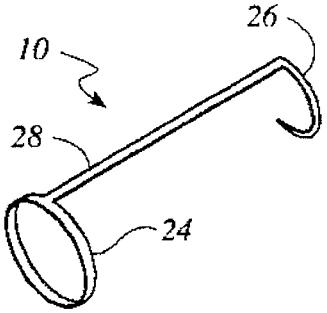
Figure 3F:
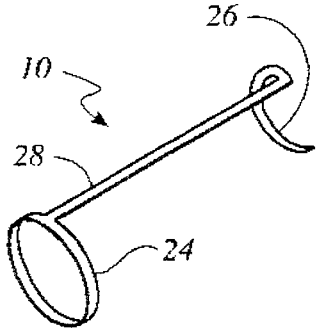
Figure 3G:
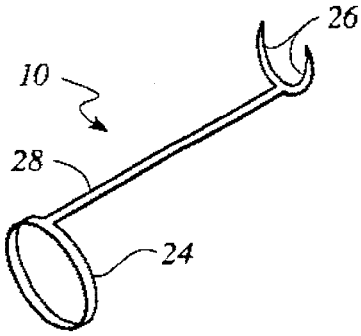
Figure 3H:
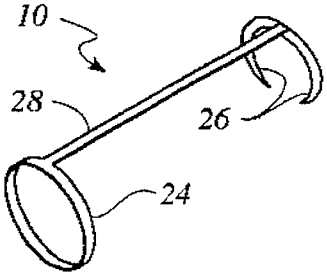
Figure 3I:
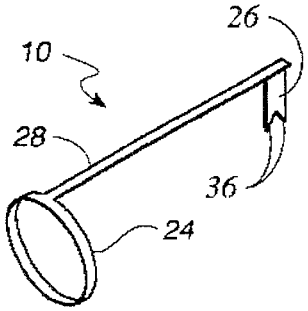
Figure 3J:
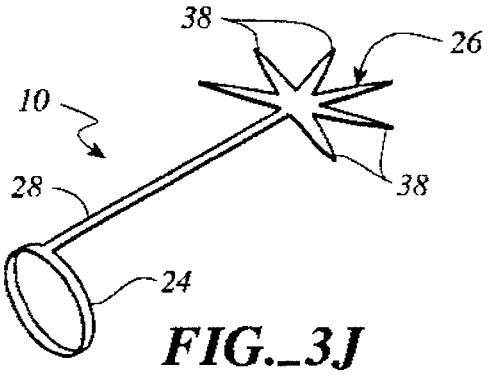
Figure 3K:
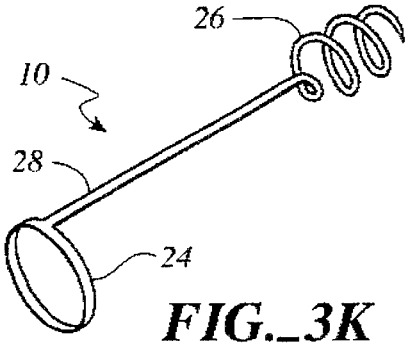

Referring to FIGS. 3A to 3K, there is shown a variety of alternative configurations for the working element 26 of the extracting and positioning device 10. As shown in FIGS. 3A to 3D and 3I, the working element 26 can have one or more pointed tip 36. As shown in FIGS. 3E to 3H, the working element 26 can have an arcuate configuration. As shown in FIGS. 3A to 3I, the working element 26 extends laterally in a transverse relationship to the support member 28. As shown in FIGS. 3E and 3F, the working element 26 has a hook-like configuration. As shown in FIG. 3J, the working element 26 has a plurality of pointed tips 38 projecting in a radial pattern from the other end 28B of the support member 28. As shown in FIG. 3K, the working element 26 has a corkscrew configuration.

FIGS. 4A to 4D depict the sequence of steps that are performed by using the device 10 of the present invention to carry out the embedded wick extracting and positioning method of the present invention. When the device 10 of the present invention, in combination with the candle lighter 12 as described above, is used to light a candle with the ignitable end of its wick embedded in wax, the following basic steps are carried out. First, as shown in FIG. 4A, the flame 22 of the lighter 12 is generated at the end 16A of rod 16 so as to heat the working element 26 of the device 10 itself. Second, as shown in FIG. 4B, the flame 22 of the lighter 12 and the heated working element 26 of the device 10 are employed to heat the wax around the embedded wick through contact therewith. Third, as shown in FIG. 4C, the lighter 12 is moved so as to maneuver the heated working element 26 to dig, pull and push and ultimately raise the embedded ignitable end of the wick from the wax to an upright position above the candle wax. Fourth, as shown in FIG. 4D, the flame 22 from the lighter 12 finally ignites the erected ignitable end of the candle wick.

When the device 10 and lighter 12 are used to light the ignitable end of a candle wick surrounded by a container or high sides of the candle, two advantages of the present invention are realized. First, the device 10 places the ignitable end of the wick easily within the reach of the flame 22. Second, the device 10 positions the ignitable end of the wick in an upright orientation where it can reliably and quickly ignite.

To summarize, the extracting and positioning device 10 of the present invention facilitates the lighting of difficult-to-reach candles with embedded wicks by softening the wax embedding the ignitable ends of the candles' wicks and extracting the embedded ignitable ends of the candle wicks to upright positions free of the wax.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

We claim:

1. A method for extracting and positioning an ignitable end of a candle wick embedded in candle wax, comprising the steps of:

(a) providing a candle lighter having a candle wick extracting and positioning device mounted to a flame discharge end of the candle lighter with a working element of the device disposed in proximity to a flame produced at the flame discharge end;

(b) heating the working element of the extracting and positioning device by projecting the flame toward the working element;

(c) melting the wax of the candle embedding the ignitable end of the candle wick by heating the wax through contact with the flame and the heated working element of the device; and (d) engaging the ignitable end of the candle wick with the heated working element of the device and raising the ignitable end of the wick from the wax to a position above the candle wax.

2. The method of claim 1 further comprising:

(e) contacting the flame with the raised ignitable end of the candle wick to ignite the raised end of the candle wick.

* * * * *